United States Patent [19]

Reiling

[11] Patent Number: 4,678,960

[45] Date of Patent: Jul. 7, 1987

[54] METALLIC HALIDE ELECTRIC DISCHARGE LAMPS

[75] Inventor: Gilbert H. Reiling, Chardon, Ohio

[73] Assignee: General Electric Company, Schenectady, N.Y.

[21] Appl. No.: 761,251

[22] Filed: Aug. 1, 1985

[51] Int. Cl.[4] ..... H01J 61/34; H01J 61/35

[52] U.S. Cl. ..... 313/25; 313/114

[58] Field of Search ..... 313/25, 112, 113, 114

[56] References Cited

U.S. PATENT DOCUMENTS

| | | | |
|---|---|---|---|
| 3,221,198 | 11/1965 | Van Der Wal et al. | 313/112 X |
| 3,234,421 | 2/1966 | Reiling | 313/25 |
| 3,400,288 | 9/1968 | Groth | 313/47 |
| 3,531,677 | 9/1970 | Loughridge | 313/112 |
| 3,995,182 | 11/1976 | Balder | 313/113 |
| 4,281,274 | 7/1981 | Bechard et al. | 313/578 X |
| 4,499,396 | 2/1985 | Fohl et al. | 313/25 |

*Primary Examiner*—David K. Moore
*Assistant Examiner*—K. Wieder
*Attorney, Agent, or Firm*—Nathan D. Herkamp; John P. McMahon; Phillip L. Schlamp

[57] ABSTRACT

A high intensity gaseous discharge lamp employs a discharge medium which emits radiation at multiple, narrow line wavelengths which combine to produce white light. Coatings are applied to the arc tube to prevent emission of certain ultraviolet and infrared wavelengths, and a cylindrical barrier blocks certain long wavelength infrared radiation from being emitted by the lamp.

10 Claims, 3 Drawing Figures

METALLIC HALIDE ELECTRIC DISCHARGE LAMPS

BACKGROUND OF THE INVENTION

The present invention relates to high efficiency gaseous electric discharge lamps, and, more particularly, to such lamps which emit light in a plurality of distinct narrow spectral lines.

The desire for increased street lighting, well lighted parking lots, and lighted freeways has increased the sky glow of the night sky due to reflected light and light which is directed upward away from the street lighting fixtures. This creates particular problems in the vicinities around astronomical observatories. As astronomers are developing advanced techniques enabling them to count very low light levels emitted by faint objects in the sky the interference with observation by sky glow has become more pronounced.

One prior art lamp type that effectively satisfies the need for lighting in the vicinity of observatories without interfering significantly with observational techniques is the low pressure sodium lamp, because it is a narrow-lined source. This narrow-lined source can be filtered or ignored in the astronomical observations. While low pressure sodium lamps satisfy astronomers needs, they are not generally satisfactory for other inhabitants of the community. The light emitted by low pressure sodium lamps is a yellow monochromatic light which causes most objects to appear in unnatural colors and is very unappealing to many people. A lamp is needed which satisfies the need of the astronomers for an easily filtered source and the desire of residents for adequate, white light.

SUMMARY OF THE INVENTION

Accordingly, it is an object of the present invention to provide an efficient light source of acceptable color rendition that will minimize the effects on astronomical observation, and at the same time produce a satisfactory outdoor illumination of high efficiency.

A more specific object of the present invention is to provide a novel gas discharge electric lamp which emits light in the visible region confined to a limited number of narrow emission lines which combine to produce a white light illumination. Briefly, the present invention provides a gaseous electric discharge lamp including an hermetically sealed, light transmissive envelope, an arc tube disposed within said envelope with a pair of electrodes located within the arc tube and connected to an electrical power source external to the envelope, a quantity of mercury within the arc tube sufficient to produce a pressure when ionized in the range of 101 to 1520 pascals, a quantity of metallic iodide within the arc tube sufficient to yield a partial pressure of about 7 pascals of vaporized iodide under normal lamp operating conditions, an inner cylindrical shield surrounding the arc tube to block transmission of long wavelength infrared radiation, a bias wire disposed around the inner shield for preventing sodium transport during normal lamp operation, and an infrared reflective coating disposed on the arc tube to prevent transmission of heat, long wavelength ultraviolet and short wave length infrared radiation. In a particularly preferred embodiment of the present invention the metallic iodide is selected from the group including sodium iodide, thallium iodide, indium iodide, cesium iodide, lithium iodide and zinc iodide.

BRIEF DESCRIPTION OF THE DRAWINGS

Further objects and advantages of the present invention together with its organization, method of operation, and the best mode comtemplated may best be understood by reference to the following description taken in conjunction with the accompanying drawings in which.

DESCRIPTION OF THE PREFERRED EMBODIMENTS

Figure 1:
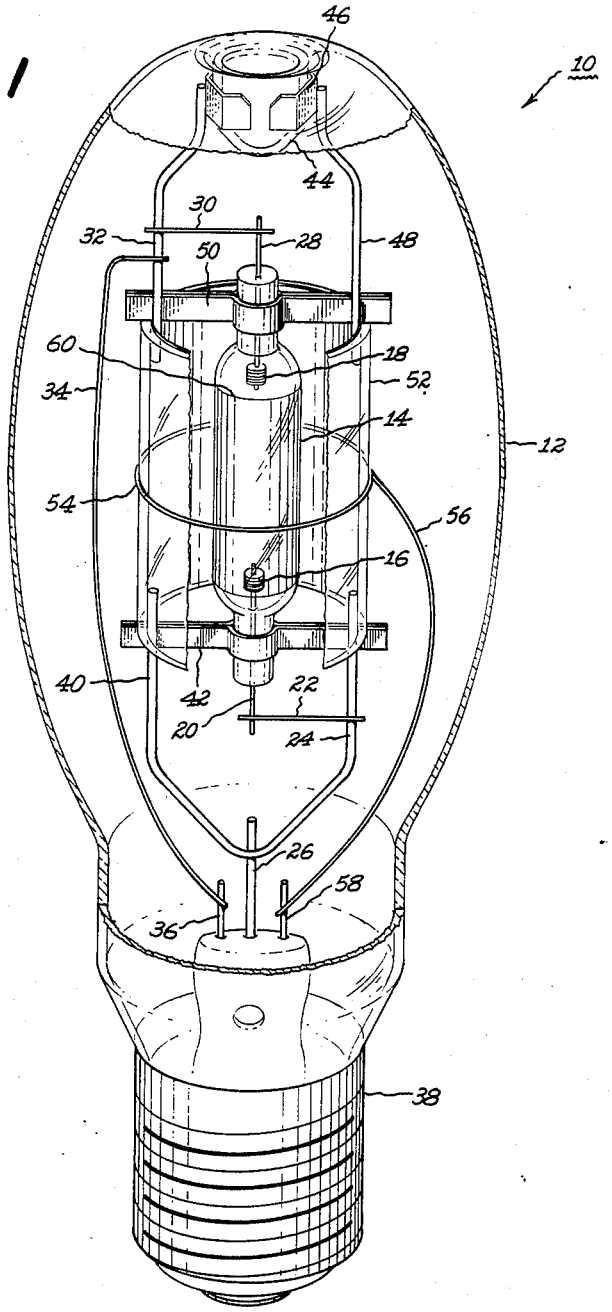
FIG. 1 is a schematic vertical pictorial view, with parts broken away of an arc discharge lamp constructed in accordance with the present invention.

As illustrated in FIG. 1, the gaseous discharge lamp 10 of the present invention includes an outer light transmissive vitreous envelope 12 having disposed therein an arc tube 14 of vitreous light transmissive material. Arc electrodes 16 and 18 are disposed at the respective ends of the arc tube 14. The electrode 16 is connected via a wire 20 and conductive elements 22 and 24 to conductive terminal element 26. The electrode 18 is connected to a wire 28 and conductive elements 30, 32 and via wire 34 to conductive terminal element 36. Elements 26 and 36 are connected electrically to the respective terminal portions of base cap 38 which is attached at one end of the vitreous envelope 12. An anchoring dimple 44 is disposed at the end of the outer vitreous envelope 12 opposite the base cap 38 and a supporting collar 46 encircles the dimple and provides support via elements 32 and 48 for bar 50. An inner shield 52 made of a material such as fused silica or hard glass which transmits all visible light wavelengths but blocks infrared radiation having a wavelength of fifteen hundred nanometers or greater is supported by bars 42 and 50 to surround arc tube 14. The upper end of the shield 52 and arc tube 14 as seen in FIG. 1 are firmly secured to the outer envelope by the dimple 44, collar 46, wires 32, 48, 30, 28 and bar 50, while the lower end of the shield 52 and arc tube 14 are firmly secured to the outer envelope by pin 26, wires 24, 40, 22, 20 and bar 42. A floating or positive bias grid wire 54 is disposed around the inner vitreous shield 52 and is electrically connected via terminal wire 56 and element 58 but is not in electrical contact with either of the electrodes. The electrodes 16 and 18 are typically tungsten wire electrodes which extend through the respective sealed ends of the arc tube 14. A suitable discharge filling such as a drop of mercury is disposed within the arc tube in an amount sufficient to create a pressure in the range of 101 to 1520 pascals, when the arc is struck and the lamp is operating. The arc tube also contains an ionizable medium for generating radiation exhibiting a plurality of distinct narrow emission lines in the visible light region of the electromagnetic spectrum; the ionizable medium including a combination of metallic iodides selected from the group of iodides including sodium iodide, thallium iodide, indium iodide, cesium iodide, lithium iodide and zinc iodide in sufficient quantity that when the lamp is operating the metallic iodides create a partial pressure of about 7 pascals of vaporized iodide. The amount of iodide is typically in the range of 1 to 30 milligrams of each metallic iodide for lamps in the range of 80 to 400 watts. An infrared reflective coating 60 is disposed on the outer surface of the arc tube 14 to reflect heat and block long wavelength ultraviolet radiation and short wavelength infrared radiation. The interior of outer envelope 12 may be filled with nitrogen gas or be evacuated to form a vacuum envelope.

Figure 3:
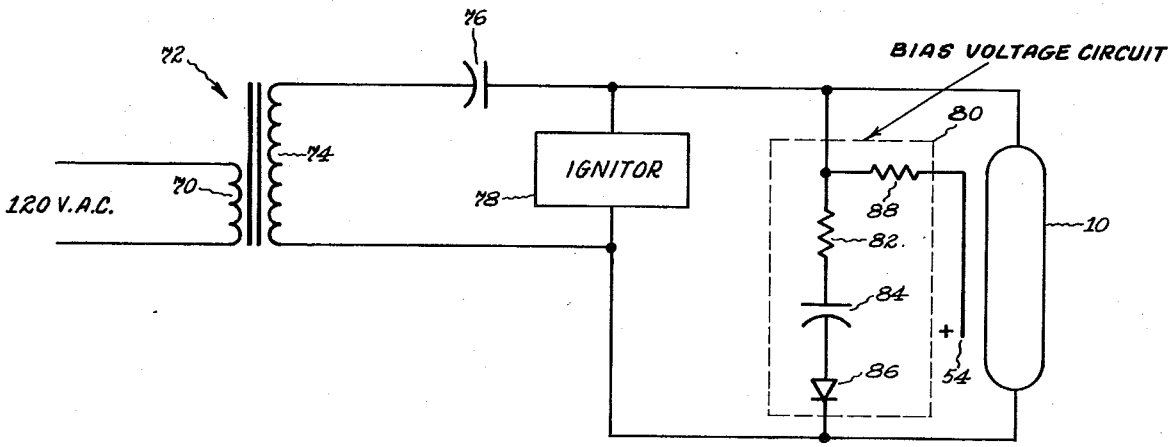
FIG. 3 is a schematic circuit diagram illustrating a power supply circuit for the lamp of the present invention.

For operation of the lamp the end cap 38 is screwed into a suitable socket connected to a power supply circuit such as that shown in FIG. 3 adapted to supply electrical current at a suitable voltage and frequency. Power from a 120 volt, 60 Hertz a-c line is applied to the primary winding 70 of ballast transformer 72. One terminal of secondary winding 74 is connected to capacitor 76 which is connected to one terminal of ignitor 78 and one terminal of the lamp 10. Bias voltage circuit 80 is connected to the capacitor 76 and includes resistor 82, capacitor 84 and diode 86 and provides a positive potential via resistor 88 to bias wire 54. The other terminal of ignitor 78, bias circuit 80 and the other terminal of lamp 10 are connected to the other terminal of secondary winding 74.

Figure 2:
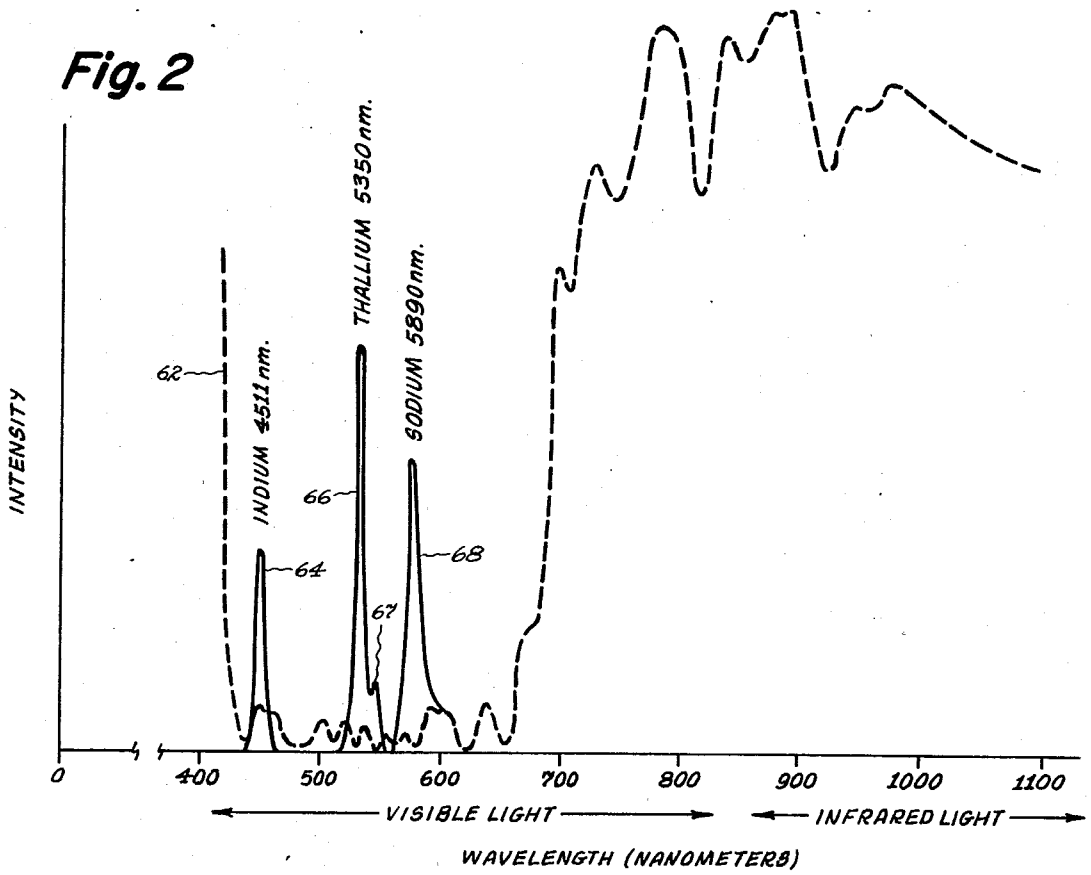
FIG. 2 is a graphical showing of the spectrum of the emission of radiation from the lamp showing the particular lines of radiation emitted by one embodiment of the lamp of the present invention.

When power is applied to the lamp, a suitable arc starting mechanism such as a starter electrode in conjunction with one of the discharge electrodes causes the mercury within the arc tube 14 to be vaporized and an arc initiated between the lamp electrodes 16, 18. The metallic iodide in the arc tube is then gradually vaporized. The electromagnetic radiation, which is then emitted, includes the characteristic mercury emission line and the emission lines of the metals of the iodide or iodides present within the arc tube. By selecting the proper quantity of each metallic halide in the arc tube, the multiple lines of radiation and their relative intensities may be chosen, such that the combination will produce white light thereby giving a satisfactory color rendering to objects lighted by the lamps. In the present invention the lamp emits radiation in from two to six narrow emission lines which together appear to the observer as white light. As shown in FIG. 2, in a lamp which includes indium iodide, sodium iodide and thallium iodide along with mercury, three narrow emission lines 64, 66 and 68 characteristic of indium, thallium and sodium, respectively, are actually produced by the lamp, even though the light appears to the human eye to be white light. A lower intensity emission line shown at 67 is characteristic of mercury, but its intensity is low enough to be ignored by observers. The coatings on the arc tube and the cylindrical reflector 52 block emission of ultraviolet and infrared radiation from the lamp illustrated in FIG. 2 by the dashed line 62 showing the relative degree of filtering effectiveness at various wavelengths. Therefore, sky glow may be removed by filtering the unwanted radiation outside of the narrow lines 64, 66, 68 emitted by the lamp, thereby allowing radiation at all other wavelengths from faint astronomical objects to reach observatories unencumbered. If the combination of metallic iodides is selected to include other materials, such as cesium iodide, lithium iodide, and zinc iodide the specific lines are at different known wavelengths, so that the materials are selected to yield white light. Various combinations of these materials may be used to provide desireable multiple line emissions of from two to six lines, with the relative intensities being controlled to be approximately equal by the selection of the quantity of each of the respective iodides in the arc tube. In addition to the desireable features of narrow line emission the lamp of the present invention limits the amount of energy emitted in the ultraviolet and infrared ranges in order to both improve the efficacy of the lamp in lumens per watt and shield this undesirable radiation from interfering with astronomical observations in the near ultraviolet and infrared portions of the spectrum.

It will therefore be readily appreciated that the present invention provides a novel and useful solution to the competing requirements of residential and commercial communities for adequate outdoor lighting and of the astronomical observatories for minimizing interference by artificial sky glow with astronomical observations.

What we claim as new and desire to secure by Letters Patent of the United States is:

1. A gaseous electric discharge lamp comprising:

an hermetically sealed vitreous light-transmissive outer envelope having electrical terminal means sealed thereinto for making electrical connection from an external power source to the interior of said envelope;

a sealed, vitreous arc tube disposed within said outer envelope;

first and second non-liquid metallic arc electrodes disposed within said arc tube and connected to electrical lead means sealed into said arc tube for making electrical connection through respective ends of said arc tube;

a quantity of mercury disposed within said arc tube sufficient upon complete evaporation thereof during operation of said lamp to yield a particle pressure of approximately 101 to 1520 pascals within said arc tube;

an ionizable medium disposed within said arc tube comprising a plurality of metallic halides; each metallic halide including a metal which emits electromagnetic radiation in the visible range of wavelengths in one of a plurality of predetermined multiple narrow emission lines, such that the total radiation emitted appears as white light;

reflector means comprising a reflective coating disposed on the exterior surface of said arc tube to reflect long wavelength ultraviolet radiation and short wavelength infrared radiation having a wavelength of less than 1500 nanometers; and a cylindrical reflector disposed within said outer envelope and surrounding said arc tube and comprising a material which blocks transmission of infrared radiation having a wavelength of at least 1500 nanometers, said reflective coating and said cylindrical reflector cooperating for reflecting infrared and ultraviolet wavelengths inward so that said infrared and ultraviolet wavelengths are substantially removed from the light output of said lamp; and conductive means for supporting said arc tube within said outer envelope and making electrical connection from said electrical terminal means to said electrical lead means.

2. The invention of claim 1 wherein said ionizable medium comprises:

a quantity of each of at least two metallic iodides selected from the group consisting of sodium oxide, thallium iodide, indium iodide, cesium iodide, lithium iodide, and zinc iodide.

3. The invention of claim 2 wherein said quantity of each of said at least two metallic iodides comprises an amount in the range of 1 to 30 milligrams.

4. The invention of claim 1 wherein said cylindrical reflector comprises:

a fused silica cylindrical reflector.

5. The invention of claim 4 further comprising:

means for controlling sodium transport in said fused silica cylindrical reflector.

6. The invention of claim 5 wherein said means for controlling sodium transport comprises:

a positive bias grid wire means surrounding said cylindrical reflector and connected to one of said terminal means for providing a positive potential to said wire.

7. The invention of claim 1 wherein said cylindrical reflector comprises:

a hard glass cylindrical reflector.

8. The invention of claim 1 wherein said ionizable medium comprises:

a quantity of each of at least three metallic iodides selected from the group consisting of sodium iodide, thallium iodide, indium iodide, cesium iodide, lithium iodide and zinc iodide.

9. The invention of claim 8 wherein said quantity of each of said at least three metallic iodides comprises an amount in the range of 1 to 30 milligrams.

10. The invention of claim 9 wherein said ionizable medium comprises:

a combination of sodium iodide, thallium iodide and indium iodide.

* * * * *